United States Patent [19]

Nakayama

[11] Patent Number: 4,793,036

[45] Date of Patent: Dec. 27, 1988

[54] APPARATUS FOR REMOVING WASTE ROVINGS FROM ROVING BOBBINS

[75] Inventor: Hiroshi Nakayama, Kanazawa, Japan

[73] Assignee: Murao Boki Kabushiki Kaisha, Kanazawa, Japan

[21] Appl. No.: 100,265

[22] Filed: Sep. 23, 1987

[30] Foreign Application Priority Data

Sep. 30, 1986 [JP] Japan ..... 61-232158

[51] Int. Cl.[4] ..... B65H 73/00

[52] U.S. Cl. ..... 28/294

[58] Field of Search ..... 28/293, 294

[56] References Cited

U.S. PATENT DOCUMENTS 3,940,825 3/1976 Murao .

*Primary Examiner*—Robert R. Mackey

*Attorney, Agent, or Firm*—Oblon, Fisher, Spivak, McClelland & Maier

[57] ABSTRACT

Apparatus for removing waste rovings from bobbins, in which the bobbins are conveyed in contact with a flocked endless belt driven in an opposite direction to the driven direction of the conveyor for the bobbins, the conveyor accommodating bobbins individually, and being provided with an air nozzle for ejecting compressed air against the bobbins, thereby removing fine fibrous waste therefrom.

6 Claims, 4 Drawing Sheets

APPARATUS FOR REMOVING WASTE ROVINGS FROM ROVING BOBBINS

FIELD OF THE INVENTION

The present invention relates to an apparatus for removing waste rovings remaining on roving bobbins during the returning thereof from a ring spinning frame to a roving frame.

BACKGROUND OF THE INVENTION

In the spinning process, slivers are drawn and twisted into rovings by a roving frame, which rovings are then wound around roving bobbins (hereinafter referred to merely as bobbins) by a fly frame. The bobbins are sent to a ring spinning frame, whereby the rovings are unwound from the bobbins. In this case, previous rovings remain on the bobbins which are returned from the ring spinning frame to the roving frame, and it is necessary to remove them before fresh rovings are wound on the bobbins.

To automatically remove such rovings from the bobbins, U.S. Pat. No. 3,940,825 discloses a system which includes a first step to keep a moving endless belt in contact with the outer surface of the bobbins while the belt is rotated in a direction in which the waste rovings are unwound, and a second step to convey the bobbins while keeping contact with a moving flocked belt (having flocks planted thereon) so as to remove the remaining rovings from the bobbins.

Recently there is a practice to use a cloth commonly called a sticking cloth which has flocks planted on its surface, the sticking cloth being attached to a surface of each bobbin. This is effective to facilitate the automatic operation of a roving frame. The flocks are inclined in one direction so as to entwine the rovings with the flocks, thereby facilitating the winding of the rovings in the fly frame.

When the sticking cloth is used, the problem is that the waste rovings also remain on the sticking cloth on each bobbin. The prior art apparatus, such as that disclosed in the noted U.S. Patent, are not suitable for removing the rovings remaining on the sticking cloths.

A further problem is that the amounts of waste rovings on the bobbins differ from bobbin to bobbin. When the rovings are removed, the amounts of them must be taken into consideration, but the prior art apparatus has no special expedient for coping with such variations in amount. Especially when a large quantity of rovings remain on the bobbins, the prior art apparatus has difficulty in removing them completely.

OBJECTS OF THE INVENTION

The present invention aims at solving the problems pointed out with respect to the prior art apparatus, and has for its object to provide an apparatus for removing waste rovings from bobbins, the apparatus being adapted for use whether the amount of the rovings is small or large.

Another object of the present invention is to provide an apparatus for such use, adapted for removing waste rovings not only from the bobbins but also from the sticking cloths attached to the bobbins.

Other objects and advantages of the present invention will become apparent from the following detailed description, when taken in conjunction with the accompanying drawings which show, for the purpose of illustration only, one embodiment in accordance with the present invention.

SUMMARY OF THE INVENTION

According to the present invention there is provided an apparatus for removing waste rovings from bobbins, the apparatus comprising:

a body structure having an opening in its top portion;

a pair of endless roller chains arranged under the opening of the body structure;

a plurality of first and second carrier plates transversely supported on the roller chains so as to accommodate bobbins between the adjacent first and second carrier plates, at least one of two adjacent carrier plates being detachable from the roller chains;

a flocked endless belt running under the roller chain, wherein the belt is spaced from the bobbins at such an interval as to allow the flocks on the belt to keep contact with the surface of the bobbins and be driven in an opposite direction to the driven direction of the roller chains;

a toothed wheel provided under the flocked belt at such an interval as to allow the teeth thereof to reach the surface of the flocked belt; and an air nozzle provided adjacent to a point where the bobbins become separated from the moving flocked belt, the air nozzle being adapted to eject compressed air against the bobbin and, particularly, against the sticking cloth attached thereon.

DETAILED DESCRIPTION OF THE PREFERRED EMBODIMENT

Figure 1:
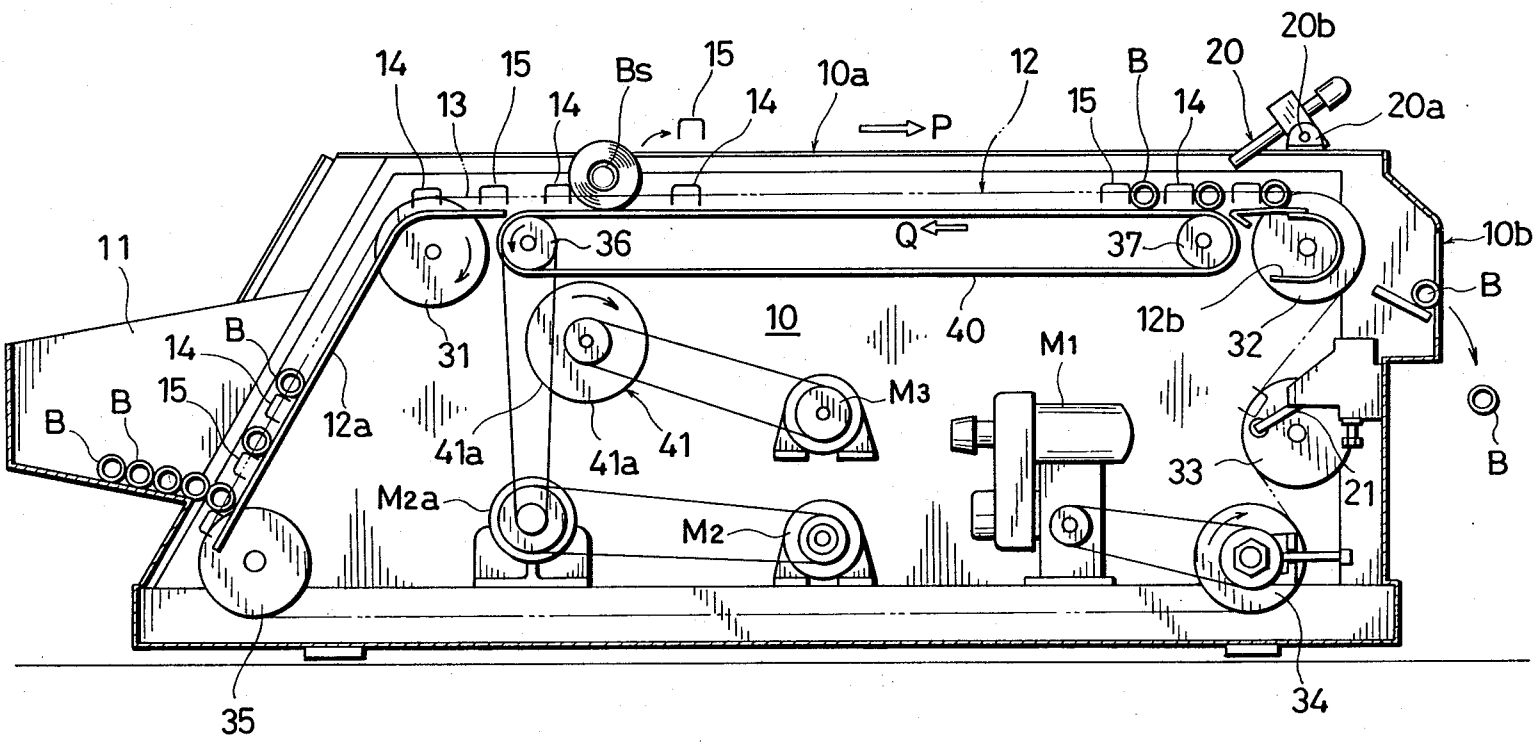
FIG. 1 is a diagrammatic side view showing an apparatus embodying the present invention.

Referring to FIG. 1 the apparatus of the present invention comprises a carrier 12 mounted on a body structure 10, the carrier 12 being adapted to carry bobbins (B); an endless belt 40 having flocks or piles planted thereon (hereinafter called "flocked belt"); a comb wheel 41; and an air nozzle 20.

Now, suppose that the bobbins (B) are carried by the carrier 12 in the direction of arrow (P) (hereinafter called "forward direction"). The body structure 10 extends in the forward direction (P), with its rear end (the left-hand end in FIG. 1) being inclined in the forward direction. A hopper 11 is provided on the rear end for supplying the bobbins (B) to the carrier 12. The front end (the right-hand end) of the body structure 10 is upright, and it has a discharge port **10*b*** for letting the bobbins (B) out.

Figure 2:
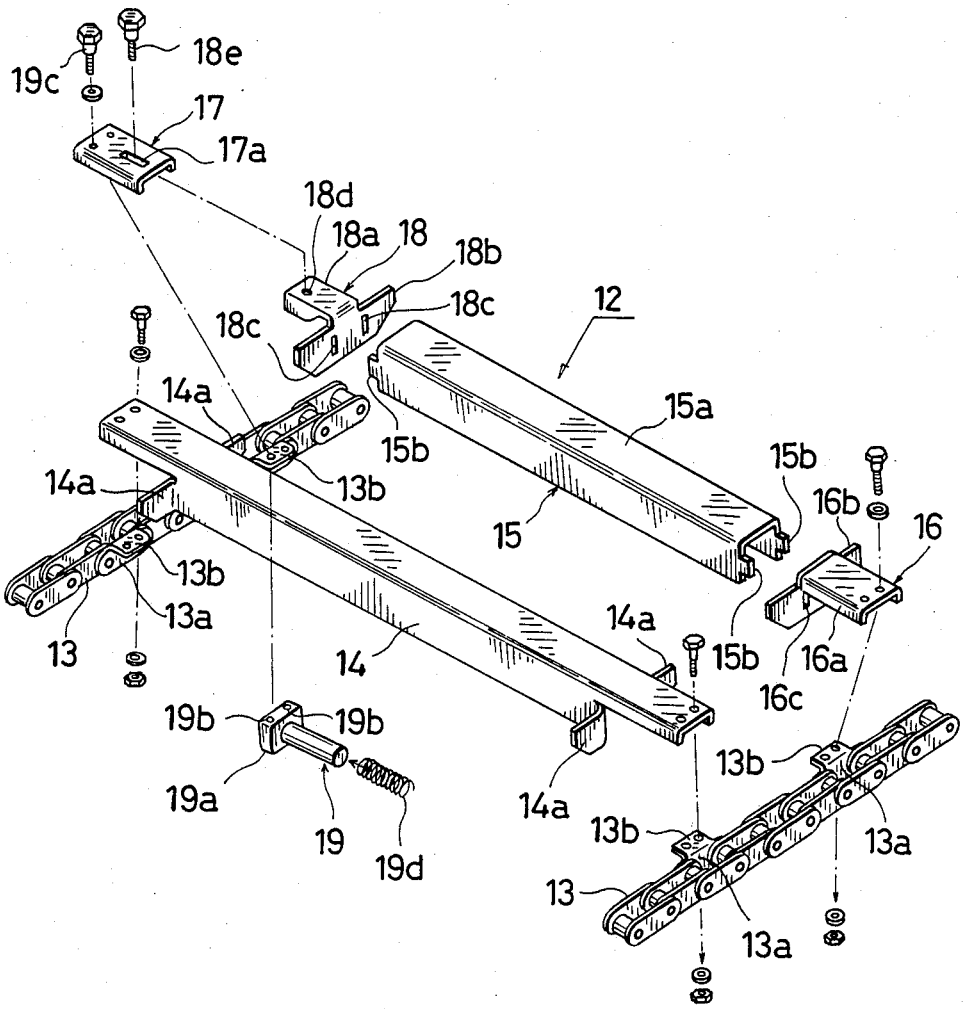
FIG. 2 is a perspective analytical view showing part of the carrier.

Referring to FIG. 2 the carrier 12 comprises a pair of roller chains 13; first carrier plates 14, and second carrier plates 15 alternately arranged transversely of the roller chains 13. The roller chains 13 are mounted on the body structure 10 in such a manner that they rotate in the forward direction (P). The first carrier plates 14 and the second carrier plates 15 are connected to brackets 13*b* fixed to link members 13*a* of the roller chains 13. The first and second carrier plates 14, 15 are made of ordinary channels, and the first carrier plates 14 are provided with tongue members 14*a*. The second carrier plates 15 are provided with projections 15*b*, and they include two plate members 16 and 17 connected thereto, with intermediate plate members 18 being interposed between the plate members 17 and the second carrier plates 15. The reference numeral 19 denotes guide pins.

The second carrier plates 15 will be more particularly described:

The plate member 16 includes a base portion 16a and a tail portion 16*b* having slots 16*c* adapted to receive the projections 15*b*. The base portion 16*a* is fixed to the bracket 13*b* of the roller chain 13. The other plate member 17 is made of a short channel having a slot 17*a* in its top side, the plate member 17 being fixed to the bracket 13*b* of the opposite roller chain 13. The intermediate plate 18 includes a base portion 18*a* which is slidably inserted in the plate member 17, and a tail portion 18*b* having slots 18*c* adapted to receive the projections 15*b*. The intermediate plate 18 is slidably fixed to the plate member 17 by means of a bolt 18*e* which is movably anchored in the slot 17*a* in the plate member 17 through a hole 18*d* in the intermediate plate 18.

Figure 4:
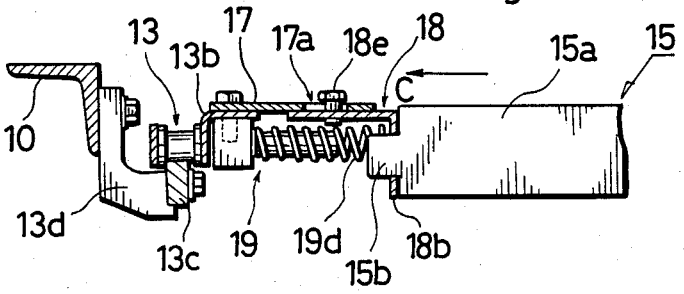
FIG. 4 is a cross-sectional view taken along the line IV—IV in FIG. 3.

The guide pin 19 is fixed to a block 19*a*, which has bores 19*b* adapted to receive bolts 19*c*. The blocks 19*a* are fixed to the brackets 18*b* of the roller chain 13 together with the plate members 17 by means of the bolts 19*c* in such a manner that the brackets 13*b* are sandwiched between the plate members 17 and the blocks 19*a*. The guide pin 19 is provided with an expanding spring 19*d* whereby the tail portions 18*b* of the intermediate plates 18 are pressed against second carrier plates 15 as best shown in FIG. 4. In this way, the projections 15*b* are prevented from withdrawing from the slots 16*c* and 18*c*.

The second carrier plates 15 are moved in the direction of arrow ($C_1$) against the spring 19*d* if a force is given in this direction. At this stage, the second carrier plates 15 are ready to come out of the roller chains 13. When the second carrier plates 15 are to be mounted on the roller chains 13, the spring 19*d* is likewise pressed in the direction of arrow ($C_1$) in FIGS. 3 and 4. The bobbin carrier 12 runs on first to fifth sprockets 31, 32, 33, 34 and 35. The fourth sprocket 34 is connected to a motor ($M_1$), and the third sprocket 33 is used for adjusting the tension of the roller chains 13. It is arranged that the carrier 12 runs horizontally between the first and second sprockets 31, 32, and that it rises along the sloping rear end of the body structure 10 between the fifth and first sprockets 35, 31. The body structure 10 has an opening 10*a* of large space above the horizontal path of the carrier 12 so as to enable an operator to place bobbins directly on the flocked belt 40 therethrough. In addition, the body structure 10 is open toward the hopper 11 in the rising path of the carrier 12. The reference numerals 12*a* and 12*b* denote protective covers for preventing the bobbins (B) from falling off the carrier 12.

Figure 3:
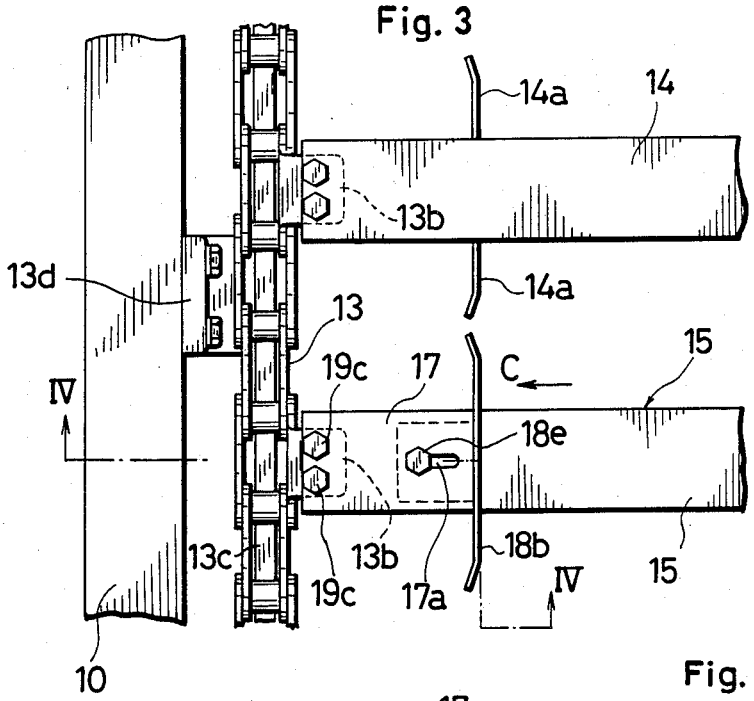
FIG. 3 is a plan view showing the carrier of FIG. 2.

The running speed of the carrier 12 depends upon the rotating speed of the motor ($M_1$). When the carrier 12 runs on the horizontal path between the first and second sprockets 31, 32, the roller chains 13 are supported from below by brackets 13*d* projecting from the body structure 10 and guide rails 13*c* provided at the top portions of the brackets 13*d* as shown in FIGS. 3 and 4.

The flocked endless belt 40 has flocks or piles of synthetic fiber planted on a substratum. The flocked belt 40 is arranged immediately below the carrier 12 along the horizontal path thereof, and it runs on rollers 36 and 37 in such a manner that the flocks on the belt 40 keep contact with the bobbins (B) on the carrier 12 and moves in the opposite direction to that of the carrier 12 (in the direction of arrow (Q) in FIG. 1). The flocks are slanted in the direction in which the belt 40 runs. The roller 36 is connected to a motor ($M_2$) through a pulley ($M_2$a).

The comb wheel 41 is a short cylinder having equally spaced teeth 41*a* on its peripheral surface. The comb wheel 41 is arranged below the flocked belt 40 in such a manner that the tip portions of the teeth 41*a* keep contact with the flocks on the belt 40. The comb wheel 41 is rotated in the same direction as the flocked belt 40 but at a greater speed than it by a motor ($M_3$).

Figure 5:
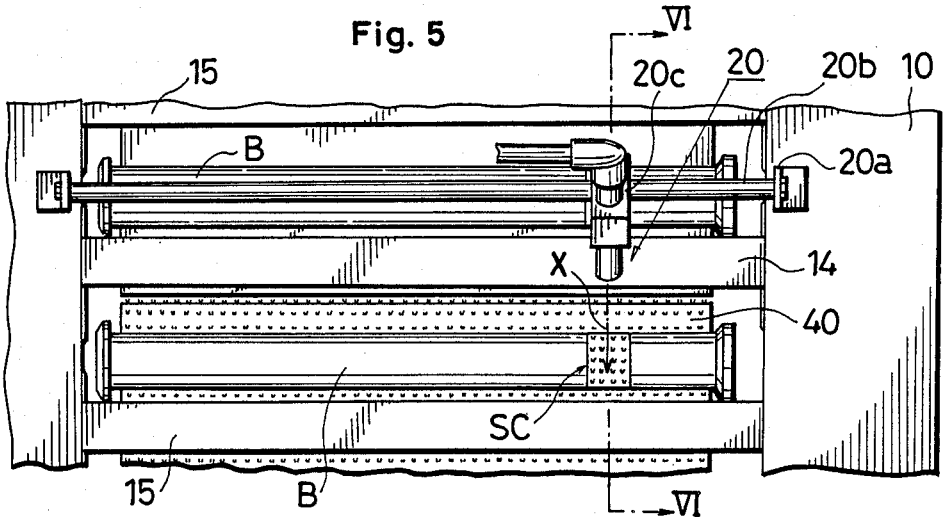
FIG. 5 is a plan view, partly broken, showing the air nozzle section.
Figure 6:
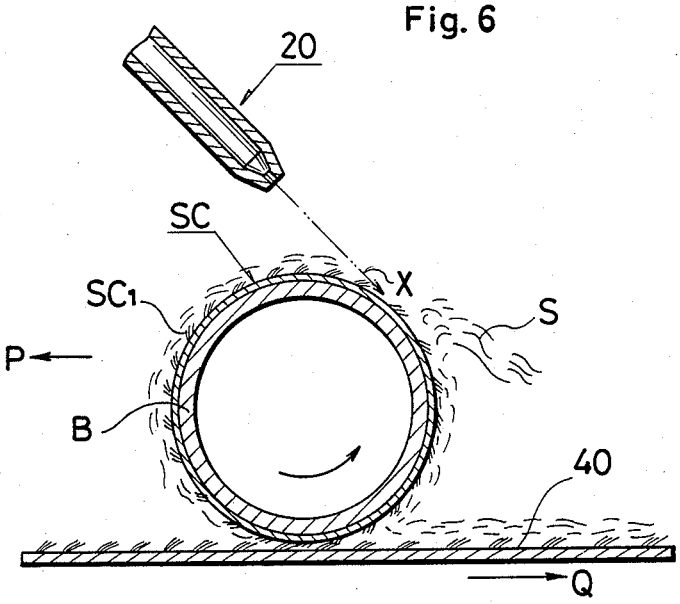
FIG. 6 is a cross-sectional view taken along the line VI—VI in FIG. 5.

As shown in FIG. 5, the air nozzle 20 is mounted on a shaft 20*b*, which is transversely supported on brackets 20*a*, at a forward end section of the body structure 10 wherein the bobbins (B) become separated from the flocked belt 40. Compressed air is ejected through the nozzle 20 in the direction of (X), which is tangential to the bobbins (B) and the sticking cloth (SC) thereon as shown in FIG. 6.

It is possible to provide several nozzles 20 on the shaft 20*b*. It is also possible to shape the opening of the nozzle 20 as desired, such as circular or rectangular.

Figure 7:
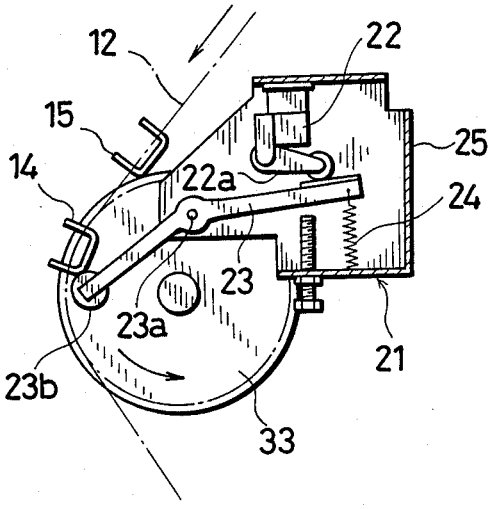
FIG. 7 is a fragmentary view exemplifying the air nozzle switching unit.

The timing for the ejection of air is controlled by means of air valve switching unit 21 provided adjacent to the third roller (tension roller) 33, the air valve switching unit 21 including a lever 23 swingable by the first and second plates 14, 15 and a valve 22 operable by the lever 23. The lever 23, which is swingable about a pin 23*a*, is provided with a roller 23*b* at its top end, and with a spring 24 at the opposite end, thereby keeping the lever 23 in contact with an actuator 22*a* for the valve 22. When the first and second carrier plates 14, 15 alternately come into contact with the roller 23*b*, they urge the lever 23 to rotate about the pins 23*a* in the counter-clockwise direction in FIG. 7. At this stage the valve 22 is operated to supply compressed air into the nozzle 20.

Figure 8:
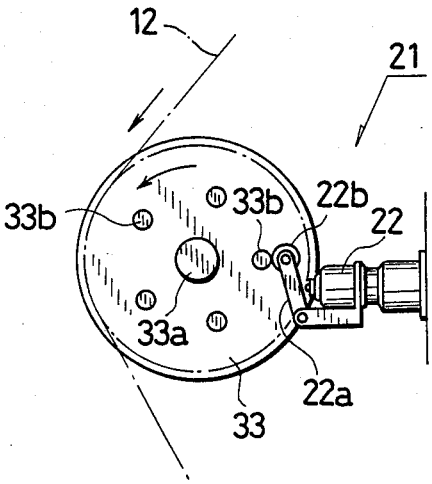
FIG. 8 is a fragmentary view showing a modified version of the air nozzle switching unit.

As shown in FIG. 8 it is also possible to provide the air valve switching unit 21 alongside the third sprocket 33, which is provided with pins 33*b* at angular equal intervals around a central shaft 33*a*. The pins 33*b* are adapted to keep contact with a roller 22*b* attached to the actuator 22*a*. The pins 33*b* comes into engagement with the roller 22*b* one after another while the third sprocket 33 rotates, thereby actuating the valve 22 intermittently.

In either embodiment, the compressed air is ejected throguh the nozzle 20 in synchronism with the running of the carrier 12 so that the air is ejected toward the bobbins (B) when they come immediately under the nozzle 20. Instead of using the air valve switching unit 21 mentioned above, it is possible to use a photo-electric switch which detects the presence of the bobbins (B) so as to transmit signals to an electromagnetic valve.

In operation, the bobbins collected from a ring spinning frame are thrown into the hopper 11, wherein each bobbin is placed in such a manner that the rovings remaining thereon are in the direction in which they are unwound by the flocked belt 40 when the bobbin is on the horizontal path of the carrier 12.

The bobbins (B) in the hopper 11 are picked up by the first and second carrier plates 14 or 15 one by one, and they are caused to rise up the protection cover 12*a*. Each bobbin (B) is maintained in an orderly posture on the carrier 12; that is, it is restrained crosswise by the tongue members 14*a* and the tail portions 16*b*, 18*b* of the plate members 16, 18, and lengthwise by the adjacent first and second carrier plates 14 and 15.

After the bobbins (B) have passed around the first sprocket 31, they come into contact with the flocks on the belt 40. As mentioned above, the flocked belt 40 rotates in the opposite direction to the direction in which the bobbins (B) are conveyed. While the bobbins (B) are conveyed, the rovings remaining thereon are unwound and taken away by the flocked belt 40. After the bobbins (B) have passed around the second sprocket 32, they are discharged through the discharge port 10*b*.

The rovings separated from the bobbins (B) tend to adhere to the surface of the flocked belt 40, but the adhering rovings are picked up by the teeth 41*a* of the comb wheel 41. The picked rovings are discharged outside as fibrous waste.

The amount of rovings removed during the conveyance of bobbins on the horizontal path of the carrier 12 depends upon how long the bobbins (B) stay on this path. The longer they stay, the more rovings will be removed. Therefore, the rotating speed of the motor ($M_1$) is reduced to enable the bobbins to stay as long as possible. It is possible to remove all the rovings if the bobbins stay sufficiently long on the horizontal path.

FIG. 6 shows a bobbin (B) having a sticking cloth (SC) attached to its surface. In this case, a fibrous waste (S) tends to stick to the flocks ($SC_1$) on the sticking cloth. This fibrous waste (S) is blown away by the compressed air through the nozzle 20 when the bobbin (B) reaches under the nozzle 20. Preferably, the air is blown in the direction in which the flocks on the stiking cloth are slanted, thereby facilitating the removal of fibrous waste. In order to enable the compressed air to reach the entire width of the sticking cloth, the base 20*c* of the air nozzle 20 is constructed to be swingable with respect to the shaft 20*b*. The nozzle 20 is swung by a pneumatic cylinder (not shown) provided between the body structure 10 and the base 20*c*. Alternatively, the base 20*c* can be provided with an eccentric cam device.

When a large quantity of rovings remain on the bobbins, it is not necesary to use the hopper 11, and the bobbins are placed directly on the carrier 12 through the opening 10*a* produced along the horizontal path. To achieve this, the second carrier plate 15 is temporarily detached in the above-mentioned manner, so as to produce a large space sufficiently to accommodate the bobbins, and the carrier 12 rotates at an extremely reduced speed on the horizontal path, or else it can be stopped, thereby allowing the bobbins to keep contact with the flocks on the belt 40 until the rovings on the bobbins are removed.

In the illustrated embodiment, the first and second carrier plates 14, 15 are alternately arranged at equal intervals on the carrier 12, and the second carrier plates 15 are detachable from the carrier 12. This arrangement is intended for accommodating bobbins having a large quantity of rovings. However, the invention is not limited to this embodiment, and various modifications are possible. For example, all the carrier plates can be detachable, or alternatively detachable carrier plates and non-detachable carrier plates can be mixed.

What is claimed is:

1. An apparatus for removing waste rovings from bobbins, said apparatus comprising:

(a) a body structure having an opening in its top portion;

(b) a pair of endless roller chains arranged under the opening in said body structure;

(c) first means for driving said pair of endless roller chains;

(d) a plurality of first and second carrier plates transversely supported on said roller chains so as to accommodate bobbins between adjacent first and second carrier plates;

(e) second means for detachably securing at least one of said adjacent first and second carrier plates to said roller chains;

(f) a flocked endless belt running under said roller chains, said flocked endless belt being spaced from said roller chains at such an interval as to allow the flocks on said flocked endless belt to contact the surface of bobbins, thereby removing rovings from the bobbins;

(g) third means for driving said flocked endless belt so that it moves in the opposite direction to the bobbins when it is in contact with the bobbins;

(h) a toothed wheel provided under said flocked endless belt at such an interval as to allow the teeth thereof to reach the surface of said flocked endless belt, thereby removing rovings from said flocked endless belt;

(i) fourth means for rotating said toothed wheel so that its teeth move in the same direction as said flocked endless belt when they are in contact with said flocked endless belt; and (j) an air nozzle provided adjacent to said endless flocked belt, said air nozzle being adapted to eject compressed air against bobbins accommodated between adjacent first and second carrier plates.

2. An apparatus as defined in claim 1, wherein each of said second carrier plates is provided with a fixed member, a movable member, and spring means for maintaining the second carrier plate between said roller chains under the action of said spring means in such a manner than the second carrier plates can be detached from said roller chains against the urging of said spring means.

3. An apparatus as defined in claim 2, wherein said second carrier plates are arranged alternately with non-detachable first carrier plates between said roller chains.

4. An apparatus as defined in claim 1, wherein said air nozzle is located at a point where it ejects compressed air tangentially to the bobbins, thereby removing fibrous waste sticking to the bobbins.

5. An apparatus as defined in claim 1, and further comprising:

(a) a plurality of sprockets about which said roller chains are trained and (b) an air valve switching means provided adjacent to one of said plurality of sprockets for said roller chains, said air valve switching means being operable by said first and second carrier plates passing around said one of said plurality of sprockets, thereby synchronizing the ejection of compressed air through said air nozzle with the passing of the bobbins.

6. An apparatus as defined in claim 1, and further comprising:

(a) a plurality of sprockets about which said roller chains are trained and (b) an air valve switching means provided adjacent to one of said plurality of sprockets for said roller chains, said air valve switching means being operable by pins erected on each carrier plate passing around said one of said plurality of sprockets, thereby synchronizing the ejection of compressed air through said air nozzle with the passing of the bobbins.

* * * * *